US005363727A

United States Patent [19]

Barth et al.

[11] Patent Number: 5,363,727

[45] Date of Patent: Nov. 15, 1994

[54] TELESCOPIC HAND TOOL APPARATUS WITH LOCKING MECHANISM

[76] Inventors: Pat Barth, 1582 Jones Dr., Ann Arbor, Mich. 48105; Guy Dardenne, 410 Maple, Ypsilanti, Mich. 48198

[21] Appl. No.: 83,495

[22] Filed: Jun. 25, 1993

[51] Int. Cl.[5] ..... B25G 1/04

[52] U.S. Cl. ..... 81/177.2

[58] Field of Search ..... 81/177.2; 403/324, 326, 403/377–379

[56] References Cited

U.S. PATENT DOCUMENTS

| | | | |
|---|---|---|---|
| 2,869,410 | 1/1959 | Prichard | 81/177.2 |
| 4,070,932 | 1/1978 | Jeannotte | 81/177.2 |
| 4,367,663 | 1/1983 | Merics | 81/177.2 |
| 4,376,397 | 3/1983 | Newby et al. | 81/177 A |
| 4,440,517 | 3/1984 | Potter et al. | 403/24 |
| 4,581,958 | 4/1986 | Shull | 81/177.2 |
| 4,586,406 | 5/1986 | Howard | 81/177.2 |
| 4,703,677 | 11/1987 | Rossini | 81/471 |
| 4,729,281 | 3/1988 | Holloway, Jr. | 81/177.2 |
| 4,817,476 | 4/1989 | Karge | 81/177.85 |
| 4,856,388 | 8/1989 | Freeman | 81/177.2 |
| 4,905,548 | 3/1990 | Colace et al. | 81/177.2 |
| 4,960,015 | 10/1990 | Mathews | 81/177.2 |
| 5,033,337 | 7/1991 | Thomas, III | 81/177.2 |

*Primary Examiner*—James G. Smith

*Attorney, Agent, or Firm*—Basile & Hanlon

[57] ABSTRACT

A locking mechanism releasably holds an elongated first member sheathed within an elongated second member at selected positions of telescopic extension and retraction between first and second end limits of travel. The locking mechanism preferably includes an elongated lock member disposed within the second member. The locking mechanism has at least one radially inwardly extending obstruction or projection movable between a first position preventing relative movement between the first and second members, and a second position allowing relative movement between the first and second members. A first embodiment of the locking mechanism provides for longitudinally reciprocal actuation of the elongated lock member between locking and releasing positions. A second embodiment provides for angular actuation of the elongated lock member between locking and releasing positions.

15 Claims, 2 Drawing Sheets

TELESCOPIC HAND TOOL APPARATUS WITH LOCKING MECHANISM

FIELD OF THE INVENTION

The present invention relates generally to hand tools and, in particular, to telescopic handles or the like for ratchet wrenches and similar tools or attachments for hand tools.

BACKGROUND OF THE INVENTION

As is well-known, a wrench is a hand tool used for holding and turning elements such as nuts, pipes, spark plugs and the like. There are many kinds of wrenches, including monkey wrenches, single-ended wrenches, double-ended wrenches, box wrenches and the like. Two common wrenches are the socket wrench, which combines an offset handle with a male drive piece having a spring-loaded bearing lock on various sized sockets, and a ratchet wrench, which is a socket wrench having a ratchet mechanism which controls the direction of applied torque.

Wrenches are used by mechanics in all sorts of applications, and under all sorts of conditions. For example, an automobile mechanic may be required to apply a ratchet wrench to various elements in an automobile engine. However, if such elements are in difficult-to-reach locations, proper application of torque can be difficult. This problem is especially apparent if the ratchet wrench is not long enough to properly reach the desired element.

It is known to provide an extendible handle for ratchet wrenches and similar tools having an elongated shank, in order to permit the operator to increase the amount of torque exerted during the use of the tool. Various devices and configurations have been disclosed providing for extensible handles. Each of these extensible handles have various locking mechanisms. Most of the locking mechanisms are complex in the number of parts required to achieve the locking and unlocking capability. In addition, most of the locking mechanisms are inherently expensive to manufacture and/or assemble. Because of the complex mechanisms previously used for performing the locking and unlocking function, the devices have been subject to increased rates of failure. Therefore, the prior known telescopic wrench devices have been undesirable, and commercially unsuccessful, because of the high cost of manufacturing and assembly, and the high rate of failure of these locking mechanisms.

Therefore, it is desirable in the present invention to provide a simple locking mechanism for providing a telescopic element of a wrench or other hand tool. It is also desirable in the present invention to provide a locking mechanism which is simple to manufacture and assemble. Furthermore, it is desirable in the present invention to provide a locking mechanism which is reliable in operation.

SUMMARY OF THE INVENTION

The present invention provides a locking mechanism for releasably holding an elongated first member sheathed within an elongated second member at selected positions of telescopic extension and retraction between first and second end limits of travel. The locking mechanism preferably includes an elongated locking member disposed generally within the second member. The locking means has at least one radially inwardly extending obstruction movable between a first position preventing relative movement between said first and second members, and a second position allowing relative movement between said first and second members. In one configuration, the elongated lock member is reciprocal between the locking position and the release position. In another configuration, the elongated lock member is disposed for rotational movement between an angular locking position and an angular release position.

In the first mentioned configuration, the second member has a hollow interior with a plurality of longitudinally spaced, radially extending apertures in communication with the hollow interior. A plurality of movable stop members are provided. Each stop member is captively disposed within a respective aperture of the second member for radial movement therein between a radially inward obstructive position and a radially outward release position. The first member has at least one stop-engaging surface for engaging at least one stop member when the stop member is in the radially inward obstructive position, such that the first member is held longitudinally stationary with respect to the second member. The elongated lock member has longitudinally spaced recesses disposed therein facing an interior of the second member. The spaced recesses are selectively locatable in radial alignment with the radially extending apertures of the second member. The stop members are held in the radially inward obstructive position when the elongated lock member is in the locking position, and the stop members are movable into the radially outward release position when the elongated lock member is in the release position.

In the second mentioned configuration, the second member has a hollow interior with a longitudinally extending groove formed therein. The second member has longitudinally spaced recesses disposed therein facing an interior of the second member and in communication with the longitudinally extending groove. The first member has a longitudinally spaced stop-receiving surface for engaging at least one stop member when the stop members are in the radially inward angular locking position such that the first member is held longitudinally stationary with respect to the second member. The elongated lock member includes a plurality of longitudinally spaced projections rotatable between a radially inwardly extending angular locking position and a radially recessed angular release position.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED AND ALTERNATIVE EMBODIMENTS

Figure 1:
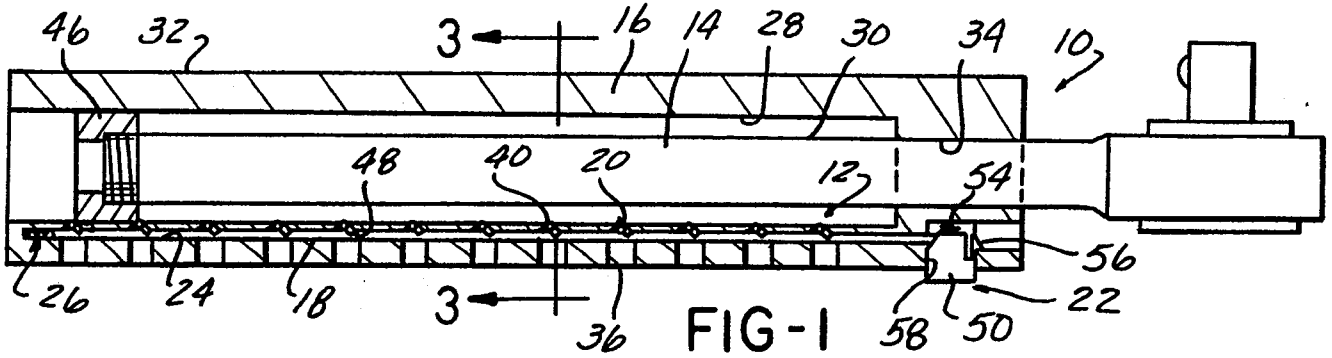
FIG. 1 is a cross-sectional view of a telescopic wrench with a locking mechanism according to a first embodiment of the present invention.
Figure 3:
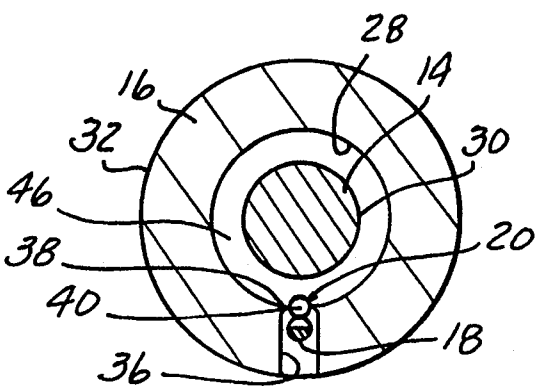
FIG. 3 is across-sectional view taken as shown in FIG. 1 showing the locking mechanism in a radially inwardly extending locking position.
Figure 2:
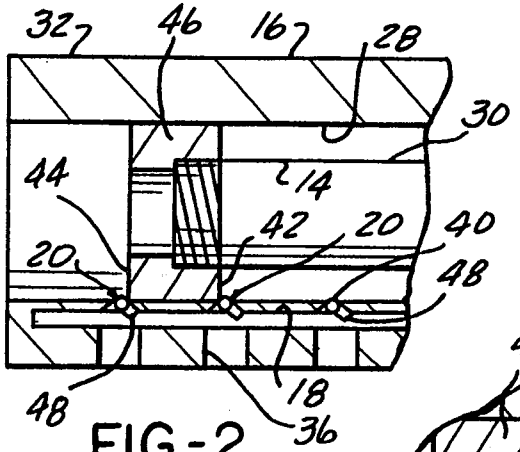
FIG. 2 is a detailed view of the embodiment shown in FIG. 1 in a locked position.

The present invention of a telescopic apparatus 10 for a hand tool, such as a ratchet wrench, includes a locking means 12 for releasably holding an elongated first member 14 sheathed within an elongated second member 16 at selected positions of telescopic extension and retraction between first and second end limits of travel. The first and second elongated members, 14 and 16 respectively, may take the form of a telescopic handle, or alternatively may be in the form of a socket extension or the like. For purpose of illustrating the present invention, the drawings depict by way of a non-limiting example, a telescopic or extensible handle for a ratchet wrench. The locking means 12 for the telescopic mechanism of the present invention preferably includes an elongated locking member 18 disposed generally within the second member 16. The locking means 12 includes at least one radially inwardly extending obstruction or projection 20 movable between a first position preventing relative movement between the first member 14 and second member 16, and a second position allowing relative movement between the first member 14 and second member 16. Push button means 22 is provided for actuating the elongated locking member 18 between the locking or first position and the release or second position.

A first embodiment of the locking means 12 is depicted in FIGS. 1–4. In this embodiment, the elongated lock member 18 is reciprocal longitudinally between the locking position and the release position within aperture 24 formed within the second member 16 extending along substantially an entire longitudinal length of the second member 16. Biasing means 26, such as a spring, is provided for urging the elongated lock member 18 toward the locking position.

The second member 16 has a hollow interior of predetermined shape as defined by surface 28. While surface 28 is depicted as being of circular cross-section in the drawings, it should be recognized that the geometric configuration of the hollow interior, and the first and second members, can be varied from that depicted as desired, provided that the configuration selected provides sufficient cross-sectional area of material for the desired strength characteristics of the tool. By way of non-limiting examples, surface 28 may define a square, rectangle or oval shape. In addition, it should be recognized that the external surface of the first member 14, or the second member 16, may take a geometric shape different from that illustrated in the accompanying drawings. For instance, exterior surface 30 of first member 14, by way of non-limiting examples, may take the form of a square, rectangle or oval shape. In addition, or alternatively, exterior surface 32 of second member 16, by way of non-limiting examples, may also take the form of a square, rectangle or oval shape. In addition, it should also be recognized that the exterior surfaces, 30 and 32 respectively, are not required to be of the same geometric cross-section, and may differ from the geometric cross-section of the interior surface 28, and from each other. Of course, aperture 34 in one end of the second member 16 for allowing passage of the first member is preferably formed of a complimentary geometric shape to the cross-sectional configuration of the first member.

The second member 16 in the first embodiment illustrated in FIGS. 1–4 preferably includes a plurality of longitudinally spaced, radially extending apertures 36 in communication with the hollow interior of the second member 16. Preferably, apertures 36 are evenly spaced longitudinally along the length of the second member 16 for reasons which will become apparent after reading the following description. Each aperture 36 includes a reduced diameter opening, such as that defined by surface 38, allowing a radially inwardly extending obstruction or projection 20 to protrude inwardly into the hollow interior defined by surface 28 while preventing complete passage of the obstruction or projection 20 through the reduced diameter opening defined by surface 38. The radially inwardly extending obstruction or projection 20 is part of a movable stop member 40 such as the radially reciprocal sphere or ball illustrated in FIGS. 1–4. Each movable stop member 40 is captively disposed within a respective aperture 36 of the second member 16 for radial movement therein between a radially inward obstructive locking position, shown in FIGS. 1–3, and a radially outward release position shown in FIG. 4.

The first member 14 has at least one stop-engaging surface for engaging at least one of the stop members 40 when the stop member is in the radially inward obstructive position so that the first member 14 is held longitudinally stationary with respect to the second member 16. Preferably, the first member 14 includes two longitudinally spaced stop-engaging surfaces, 42 and 44, for engaging two longitudinally spaced stop members 40 when the stop members are in the radially inward obstructive position so that the first member is held longitudinally stationary with respect to the second member. In this preferred configuration, it is desirable to have the stop members longitudinally evenly spaced with respect to one another along the longitudinal length of the second member 16 so that a plurality of lockable positions are provided for telescopic extension and retraction of the first member with respect to the second member between the first and second end limits of travel.

In the illustrated embodiment shown in FIGS. 1–4, the first and second stop-engaging surfaces 42 and 44 are formed on an enlarged end portion 46 of second member 16. The enlarged end portion 46 is securely connected to the elongated second member 16, such as by threading. While other methods of connection between the enlarged end portion 46 and the elongated second member 16 may be used, a threaded fitting provides for easy initial assembly of the device, and provides a simple method of disassembling the device for service and repair. The longitudinally evenly spaced radially extending apertures 36 are disposed at a distance from one another in the longitudinal direction generally equal to the longitudinal distance between the first and second stop-engaging surfaces, 42 and 44 respectively, so that the radially inwardly extending obstruction or projection 20 formed on stop member 40 engages with the respective stop-engaging surface on either side of the enlarged end portion 46 preventing longitudinal movement of the first member 14 relative to the second member 16 when the elongated locking member 18 is in the locking position.

Figure 4:
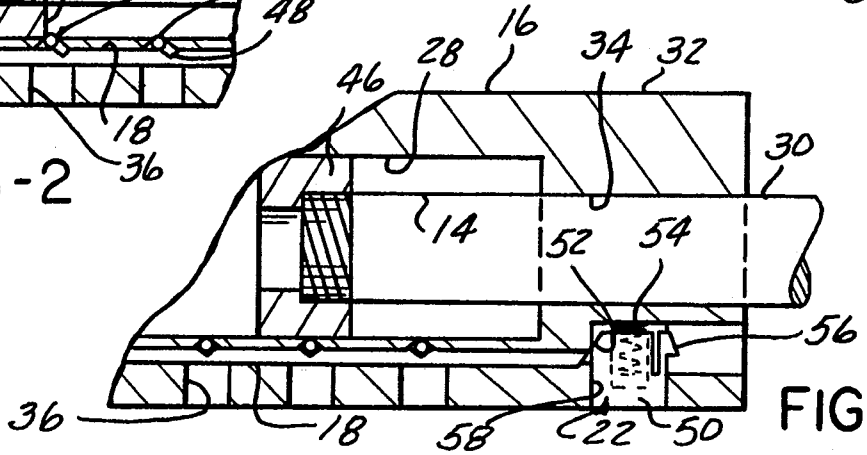
FIG. 4 is a detailed cross-sectional view showing the locking mechanism in a release position and the inner handle member movable with respect to the outer handle member.

The elongated locking member 18 includes longitudinally spaced recesses 48 disposed therein facing the hollow interior of the second member 16. The spaced recesses 48 are selectively locatable in radial alignment with the radially extending apertures 36 of the second member 16. The stop members 40 are held in the radially inward obstructive locking position when the elongated lock member 18 is in the locking position. The stop members 40 are movable into the radially outward release position when the elongated lock member 18 is in the release position and the recesses 48 are aligned with the apertures 36. The elongated lock member 18 is reciprocally movable in the embodiment illustrated in FIGS. 1–4 by push button means 22. The push button means 22 preferably includes a radially displaceable push button 50 movable between a normal radially outwardly extending locked position as shown in FIG. 1 and a radially inwardly displaced release position as shown in FIG. 4. The push button 50 preferably includes an inclined surface 52 for sliding engagement with the elongated lock member 18. If required, a complimentary angled surface can be provided on the elongated lock member 18 for orientating the recesses 48 toward the hollow interior of the second member 16. Biasing means 54, such as a spring, is provided for urging the push button 50 into the normally radially outwardly extending position allowing the lock member 18 to be urged by biasing means 26 into the locking position. After downward manipulation of the push button 50, as shown in FIG. 4, the lock member 18 is reciprocated in longitudinal direction by engagement with inclined surface 52 against the urging of biasing means 26 to radially align recesses 48 with radially extending apertures 36 such that stop members 40 may be radially moved to a radially outwardly disposed release position allowing free relative movement between the first member with respect to the second member, and in particular allowing free passage of the enlarged end portion 46 of the first member through the hollow interior surface 28 of the second member 16. Longitudinally outwardly extending tab 56 is formed on push button 50 for retaining the push button 50 within the push button receiving aperture 58 formed in the second member 16.

Referring now to FIGS. 5–9, an alternative embodiment of the telescopic apparatus 10 for a ratchet wrench according to the present invention is illustrated. The telescopic apparatus 10 includes locking means 12 for releasably holding an elongated first member 14 sheathed within an elongated second member 16 at selected positions of telescopic extension and retraction between first and second end limits of travel. The locking means 12 preferably includes an elongated lock member 18 disposed generally within or between the first and second members, 14 and 16 respectively. The locking means 12 further includes at least one radially inwardly extending obstruction or projection 20 movable between a first position preventing relative movement between the first and second members, 14 and 16 respectively, and a second position allowing relative movement between the first and second members, 14 and 16 respectively.

Push button means 22 is provided for operably actuating the lock member 18 to move the projection 20 between the first and second positions. In this embodiment, a longitudinally extending groove or aperture 24 is formed along the interior surface 28 of the second member 16 for receiving the lock member 18. The longitudinally extending aperture or groove 24 preferably includes longitudinally spaced enlarged recesses 60 disposed in the interior surface 28 in communication with the aperture 24 and facing the hollow interior of the second member 16. Preferably, the recesses 60 are evenly spaced longitudinally along the length of the second member for providing a plurality of selected locations at which the first member can be held stationary longitudinally with respect to the second member.

As previously described, the first member 14 has at least one stop-engaging surface 42 for engaging at least one stop member 40 when the stop member 40 is in a radially inward locking position to hold the first member 14 longitudinally stationary with respect to the second member 16. Preferably, the first member 14 includes first and second stop-engaging surfaces 42 and 44. The first and second stop-engaging surfaces 42 and 44 respectively define an enlarged end portion 46 of the first member 14. The enlarged end portion 46 is preferably releasably attached to the first member, such as by threading, to allow easy and cost effective methods of assembling the apparatus and further allowing a simple method of disassembly for any required service.

Figure 9:
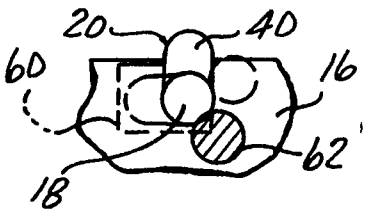
FIG. 9 is an enlarged detailed view showing the elongated lock member in the angular locking position and with the angular release position shown in phantom.

The elongated lock member 18 preferably includes a plurality of longitudinally spaced projections 20 rotatable between a radially inwardly extending angular locking position shown enlarged in solid lines of FIG. 9 and a radially recessed angular release position shown in phantom in FIG. 9. Preferably, the projections 20 are longitudinally evenly spaced along the longitudinal length of the lock member 18 for engagement with the first and second stop-engaging surfaces 42 and 44 respectively to hold the first member 14 longitudinally stationary with respect to the second member 16 when in the angular locking position. When the elongated lock member 18 is rotated through a predefined angular arc about the longitudinal axis of the elongated member 18, the projections 20 are rotated into the longitudinally spaced enlarged recesses 60 allowing free passage of the enlarged end portion 46 through the hollow interior surface 28 of the second member 16. It should be clear that this alternative embodiment can include the same variations in exterior surface configurations as previously mentioned with respect to the first embodiment, any combination or variation of one or more of these surfaces is acceptable as previously described.

Figure 5:
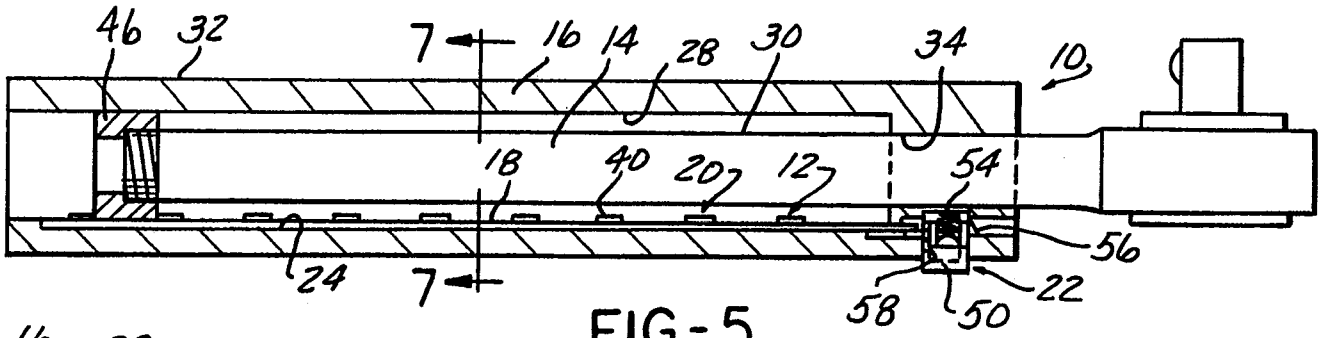
FIG. 5 is a cross-sectional view of a telescopic wrench with a locking mechanism according to the second embodiment of the present invention.
Figure 7:
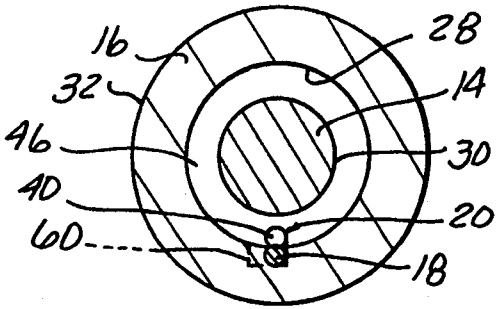
FIG. 7 is a cross-sectional view taken as shown in FIG. 5 with radially inwardly extending projections holding the inner member stationary relative to the outer member.
Figure 6:
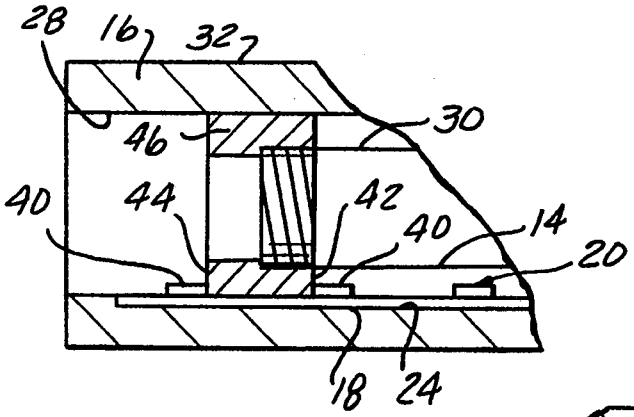
FIG. 6 is a detailed view of the embodiment shown in FIG. 5 in a locking position.
Figure 8:
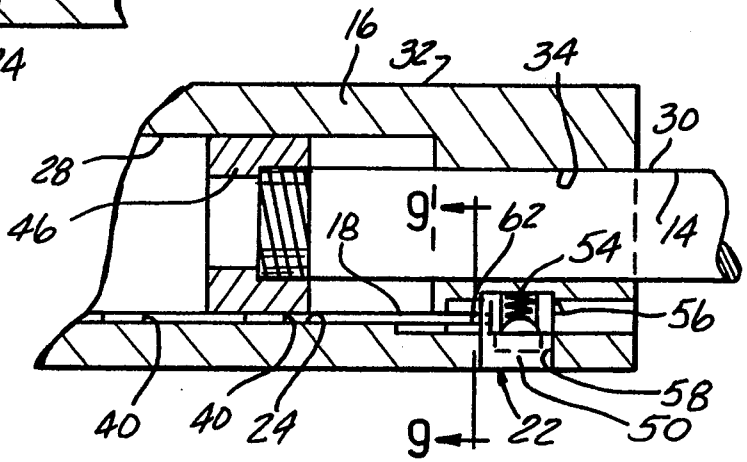
FIG. 8 is a detailed cross-sectional view showing the locking mechanism in a release position and the inner handle member movable with respect to the outer handle member.

The push button means 22 of this configuration can include a radially displaceable push button 50 disposed within a push button receiving aperture 58 formed in the second member 16. Biasing means 54 are provided to bias the push button 50 in a normally radially outwardly extending locked position as illustrated in FIG. 5. Manual manipulation of the push button 50 radially inwardly results in angular displacement of the elongated lock member 18 about the longitudinal axis through connection of offset portion 62 connected to the push button 50 at one end and the elongated member 18 at the other end. The use of the offset portion 62 to convert linear movement of the push button 50 to angular movement of the elongated lock member 18 is conventional and well known structure of such a joint. This angular rotational displacement of the locking member 18 causes the projections 20 to move from the radially inwardly extending obstructing locked position, to a radially outwardly recessed release position within the enlarged recesses 60 as more clearly shown in FIGS. 8 and 9. Push button 50 is urged into the normally radially outwardly extending position by biasing means 54 for normally holding the locking member 18 in an angular orientation where the projections 20 extend radially inwardly to lock the enlarged end portion 46 of the first member in a desired longitudinally stationary position as illustrated in FIGS. 5–7. A longitudinally outwardly extending tab 56 is formed on the push button 50 for holding the push button 50 within the aperture 58 formed in the second member 16.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a telescopic hand tool apparatus having locking means for releasably holding an elongated first member sheathed within an elongated second member at selected positions of telescopic extension and retraction between first and second end limits of travel, the improvement of said locking means comprising:

said second member having a longitudinally extending aperture disposed therein offset from and parallel to a longitudinally extending central axis of the second member, an elongated lock member disposed within said longitudinally extending aperture of said second member; and at least one obstructive projection movable between a first position preventing relative movement between said first and second members and a second position allowing relative movement between said first and second end members.

2. The apparatus of claim 1 wherein said locking means further comprises:

said elongated lock member moveable longitudinally between a locking position and a release position.

3. The apparatus of claim 1 wherein said locking means further comprises:

said elongated lock member moveable rotatably between an angular locking position and an angular release position.

4. The apparatus of claim 2 wherein said locking means further comprises:

said second member having a first surface defining a hollow interior and a plurality of radially extending apertures in communication with said hollow interior;

said at least one obstructive projection including a plurality of moveable stop members, each stop member captively disposed within a respective one of said plurality of radially extending apertures of said second member for radial movement therein between a radially inward obstructive locked position and a radially outward release position;

said first member having at least one stop-receiving surface for engaging at least one stop member when said stop member is in said radially inward obstructive position such that said first member is held longitudinally stationary with respect to said second member; and said elongated lock member having longitudinally evenly spaced recesses disposed therein facing said hollow interior of said second member, and selectively locatable in radial alignment with said radially extending apertures of said second member, said stop members held in said radially inward obstructive position when said elongated lock member is in said locking position, said stop members moveable into said radially outwardly release position when said elongated lock member is in said release position.

5. The apparatus of claim 3 wherein said locking means further comprises:

said second member having a first surface defining a hollow interior, a longitudinally extending aperture in communication with said hollow interior and a plurality of longitudinally spaced enlarged recesses formed in communication with said hollow interior and said aperture;

said at least one obstructive projection including a plurality of moveable stop members, each stop member disposed on said elongated lock member and extendable into said apertures in response to angular movement of said lock member about a longitudinal axis between a radially inward obstructive locked position and a radially outward release position;

said first member having at least one stop-receiving surface for engaging at least one stop member when said stop member is in said radially inward obstructive position such that said first member is held longitudinally stationary with respect to said second member; and said elongated lock member disposed within said aperture with said projections facing said hollow interior of said second member, said lock member selectively rotatable about said longitudinal axis for moving said stop members into and out of engagement with said recesses of said second member, said stop members held in said radially inward obstructive position when said elongated lock member is in said locking position, said stop members in said radially outwardly release position when said elongated lock member is in said release position.

6. The apparatus of claim 1 wherein said lock means further comprises:

push button means for actuating said lock member, said push button means disposed in said second member.

7. The apparatus of claim 6 wherein said push button means further comprises:

said second member having a generally radially outwardly extending push button-receiving aperture;

a push button disposed within said push button-receiving aperture for radial reciprocation between a normal radially outward locked position and a depressed radially inward release position; and biasing means for urging said push button toward said normal locked position.

8. The apparatus of claim 1 further comprising:

said first member having an enlarged portion adjacent one end and sheathed within the second member for reciprocal movement between first and second end limits of movement, said enlarged portion including at least one projection-engaging surface for locking engagement with said projection when said projection is in said first position.

9. The apparatus of claim 8 wherein said enlarged portion further comprises:

at least two projection-engaging surfaces disposed spaced longitudinally from one another by a predetermined distance for locking engagement with at least two longitudinally spaced projections for holding said first member longitudinally stationary with respect to said second member when said projections are in said first position.

10. In a telescopic hand tool apparatus having locking means for releasably holding an elongated first member sheathed within an elongated second member at selected positions of telescopic extension and retraction between first and second end limits of travel, the improvement of said locking means comprising:

said second member having a first surface defining a hollow interior, a longitudinally extending aperture in communication with said hollow interior;

an elongated lock member disposed within said longitudinally extending aperture of said second member;

a plurality of obstructive projections moveable between a first position preventing relative movement between said first and second members, and a second position allowing relative movement between said first and second members;

said first member having an enlarged portion adjacent one end and sheathed within the second member for reciprocal movement between said first and second end limits of movement, said enlarged portion including a plurality of projection-engaging surfaces for locking engagement with said projections, when said projections are in said first position;

push button means for actuating said lock member, said push button means disposed in said second member.

11. The apparatus of claim 10 wherein said locking means further comprises:

said elongated lock member moveable longitudinally between a locking position and a release position.

12. The apparatus of claim 10 wherein said locking means further comprises:

said elongated lock member moveable rotatably between an angular locking position and an angular release position.

13. The apparatus of claim 11 wherein said locking means further comprises:

said second member having a plurality of radially extending apertures in communication with said hollow interior;

each said projection disposed on a respective moveable stop member, each stop member captively disposed within a respective one of said plurality of radially extending apertures of said second member for radial movement therein between a radially inward obstructive locked position and a radially outward release position; and said elongated lock member having longitudinally evenly spaced recesses disposed therein facing said hollow interior of said second member, and selectively locatable in radial alignment with said radially extending apertures of said second member, said stop members held in said radially inward obstructive position when said elongated lock member is in said locking position, said stop members moveable into said radially outwardly release position when said elongated lock member is in said release position.

14. The apparatus of claim 12 wherein said locking means further comprises:

said second member having a longitudinally extending aperture in communication with said hollow interior and a plurality of longitudinally spaced enlarged recesses formed in communication with said hollow interior and said aperture;

each of said projections disposed on a respective moveable stop member, each stop member disposed on said elongated lock member and extendable into said recess in response to angular movement of said lock member about a longitudinal axis between a radially inward obstructive locked position and a radially outward release position and said elongated lock member disposed within said aperture with said projections facing said hollow interior of said second member, said lock member selectively rotatable about said longitudinal axis for moving said stop members into and out of engagement with said recesses of said second member, said stop members held in said radially inward obstructive position when said elongated lock member is in said locking position, said stop members in said radially outwardly release position when said elongated lock member is in said release position.

15. The apparatus of claim 10 wherein said push button means further comprises:

said second member having a generally radially outwardly extending push button-receiving aperture;

a push button disposed within said push button-receiving aperture for radial reciprocation between a normal radially outward locked position and a depressed radially inward release position; and biasing means for urging said push button toward said normal locked position.

* * * * *